US008177658B1

(12) United States Patent
Johnson

(10) Patent No.: US 8,177,658 B1
(45) **Date of Patent: *May 15, 2012**

(54) WEIGHT DEVICE ADJUSTABLY SECURED IN GOLF CLUB SHAFT

(76) Inventor: John Johnson, Ventura, CA (US)

( * ) Notice: Subject to any disclaimer, the term of this patent is extended or adjusted under 35 U.S.C. 154(b) by 82 days.

This patent is subject to a terminal disclaimer.

(21) Appl. No.: 12/317,567

(22) Filed: Dec. 22, 2008

Related U.S. Application Data

(60) Provisional application No. 61/009,052, filed on Dec. 26, 2007.

(51) Int. Cl.
*A63B 53/16* (2006.01)

(52) U.S. Cl. ..... 473/297

(58) Field of Classification Search ..... 473/296–299; 403/367, 370, 350–351, 109.4, 109.5; 411/34, 411/37

See application file for complete search history.

(56) References Cited

U.S. PATENT DOCUMENTS

| | | | | | |
|---|---|---|---|---|---|
| 1,919,666 | A | * | 7/1933 | Patterson | 16/38 |
| 2,430,737 | A | * | 11/1947 | Roe | 16/39 |
| 2,520,375 | A | * | 8/1950 | Roe | 16/39 |
| 3,504,498 | A | * | 4/1970 | Triplett | 411/34 |
| 3,651,651 | A | * | 3/1972 | Triplett | 411/34 |
| 3,692,306 | A | | 9/1972 | Glover | |
| 4,059,270 | A | | 11/1977 | Sayers | |
| 5,528,927 | A | | 6/1996 | Butler | |
| 5,547,189 | A | * | 8/1996 | Billings | 473/305 |
| 5,792,007 | A | * | 8/1998 | Billings | 473/305 |
| 6,514,154 | B1 | | 2/2003 | Finn | |
| 6,765,156 | B2 | | 7/2004 | Latiri | |
| 7,481,716 | B1 | * | 1/2009 | Johnson | 473/297 |
| 7,699,718 | B2 | * | 4/2010 | Lindner | 473/297 |
| 2005/0054459 | A1 | * | 3/2005 | Oldenburg | 473/297 |
| 2007/0161431 | A1 | * | 7/2007 | Lindner | 473/316 |
| 2007/0243947 | A1 | * | 10/2007 | Cheng | 473/316 |

FOREIGN PATENT DOCUMENTS

GB 2309389 A * 7/1997

OTHER PUBLICATIONS

U.S. Appl. No. 11/707,725, filed Feb. 17, 2007, Johnson, Allowed Application.

* cited by examiner

*Primary Examiner* — Stephen L. Blau
(74) *Attorney, Agent, or Firm* — J. E. McTaggart

(57) ABSTRACT

A weight device for golf clubs can be secured at a selected location within the shaft. A cylindrical weight element is typically disposed between two expansion elements, all three elements being traversed by a machine screw that engages a threaded lower end plate. The screw head is made to be engaged and driven by a special elongated tool to put the device in a sliding-friction mode for moving to any desired location within a golf club shaft, where the device can be secured in place by rotating the screw clockwise to expand the expansion elements against the shaft bore in a compression-secured mode. A permanent magnet affixed to the tool enables upward relocation or removal of the weight device.

16 Claims, 3 Drawing Sheets

WEIGHT DEVICE ADJUSTABLY SECURED IN GOLF CLUB SHAFT

PRIORITY

Benefit is claimed under 35 U.S.C. 119(e) of pending provisional application 61/009,052 filed Dec. 26, 2007.

This invention is in the field of sports equipment and more particularly relating to the game of golf, providing capability of adding a selectable amount of weight inside the shaft of an existing golf club and affixing the weight at a selectable location anywhere within the length of the shaft.

BACKGROUND OF THE INVENTION

In ongoing evolution in the game of golf, along with a shift to lighter weight shafts there has been increased interest in custom-matching golf clubs to individual golfers in recognition of the differences that characterize individual golfers such as height, weight, strength, firmness of grip, path and velocity of swing, etc., and the differences in golf clubs such as total length, total weight, weight distribution considering head weight, shaft weight and grip weight, along with other variables such as shaft stiffness and related resonances. The overall result of these variables determines how a particular club "feels" to that particular golfer.

For club-matching purposes, the golf industry developed a rating known as "swing-weight", based on balance measurements made on the club about a fulcrum point usually twelve or fourteen inches from the club cap, characterizing the club on a scale of 77 increments with letters A-G followed by numerals 1-10. Industry standards are D0 or D1 for men and C5 to C7 for women. In another rating system, the MOI (moment of inertia: in physics the product of mass and distance from the axis of rotation) is expressed in terms of total club weight and distance from the center of gravity (balance point) to an arbitrary axis of rotation, usually taken at the club cap end, but suggested by the present inventor as more realistic if taken at an outside point, e.g. twelve inches beyond the cap.

Many golfers including pros are not fully satisfied with the existing rating systems and regard them as approximate guidelines at best, so there is an unfulfilled need for after-market accessories that enable even initially "matched" golf clubs to be fine-tuned to more closely match the golfer's individual physique and needs for improved performance.

DISCUSSION OF KNOWN ART

U.S. Pat. No. 6,765,156 B2 to Latiri for a GOLF CLUB SWING WEIGHT BALANCE AND SCALE provides detailed description regarding "swing weight" and its measurement.

U.S. Pat. No. 5,528,927 to Butler et al for a CENTER OF GRAVITY LOCATOR discloses apparatus and method for measuring "center of gravity" of an object such as a golf club head.

U.S. Pat. No. 4,059,270 to Sayers for METHOD FOR CUSTOM FITTING GOLF CLUBS discloses a device utilizing a system of photobeam measurers to detect the speed imparted to a golf ball and the related variables. In describing the method of evaluating and custom-fitting golf clubs to players, this patent sets forth "swing weight" and club length as the two major variable factors relating to optimization of the golf club.

As examples of patents that teach adding mass to the club head the Sayer patent cites U.S. Pat. Nos. 1,306,029, 1,538, 312, 2,163,091, 2,750,194 and 3,692,306. A more recent example, U.S. Pat. No. 6,514,154 to Finn discloses a GOLF CLUB HAVING ADJUSTABLE WEIGHTS AND READILY REMOVABLE AND REPLACEABLE SHAFT.

Approaches to after-market weight-balancing golf clubs have included weights, e.g. in the form of a sleeve or lead tape to be attached on the outside of the shaft. As an environmental hazard, lead tape has become unpopular. Since other external approaches are considered unsightly, alternative internal approaches have included inserting a cork or other weight in the bore of the shaft of the club, pushing it in to an estimated best location where it is retained adhesively or by a tight friction fit such that typically it cannot be removed or even shifted upwardly in the shaft. Known golf club weighting approaches have suffered other drawbacks, for example:

(1) unless the weight is made removable, it cannot be replaced to adjust to a lighter value: it can only be increased by adding another weight;

(2) readjustment of the weight location, which is often desired, is impossible with adhesive fastening; with frictional fastening, typically the weight can be pushed further downwardly but cannot be shifted upwardly in the shaft;

(3) a friction plug of relatively rigid material fails to accommodate the variations in the diameter of the tapered shaft bore, typically decreasing from 0.5 inches at the cap end to about 0.3 inches at the head end, thus the available range of location of any single weight plug is inadequate; and (4) there is a high probability of failure of the weight fastening system, allowing the weight to shift from the desired location under the strong forces applied during the swing stroke and in general handling and transporting of the golf clubs.

Numerous patents and approaches such as these have failed to fully satisfy the unfulfilled need for an after-market device for conveniently and reliably "balancing" the club to match the golfer, i.e. adding a judicious amount of weight at a strategic "sweet spot" selected as optimal along the shaft to match the golfer and enhance the level of performance.

OBJECTS OF THE INVENTION

It is a primary object of the present invention to provide capability of adjusting and setting the balance of any golf club through the addition of a selectable amount of weight inside the shaft in a manner that it can be positioned throughout the length of a tapered shaft bore and secured reliably in place.

It is a further object that after being secured in place, the weight can be released, relocated upward or downward and again secured reliably in place.

SUMMARY OF THE INVENTION

The objects of the invention have been accomplished by a generally cylindrical weight device including at least one expansion element made of sufficiently rubber-like material and dimensioned such that lengthwise compression causes radial expansion to a predetermined diameter range corresponding to at least a major portion of the typical diameter range of golf club shaft bores.

The device includes at least one weight element and one expansion element. Typically the device is configured with three cylindrical shaped elements, each with a central passageway, located co-linearly, i.e. a single weight element located between a lower expansion element and an upper expansion element.

The lower expansion element is configured at its lower end with a threaded bushing that serves as a compression plate engaged by a captive steel machine screw that traverses the passageways. A washer under the screw head forms a compression plate at the upper end.

The device is initially pushed in to place using a special tool with an elongated shaft ending in a hex driver end that engages a hex socket in the head of the machine screw. The tool includes a permanent magnet acting on the screw head so as to retain engagement and to enable the weight device to be pulled upwardly in the golf club shaft.

Initially the device is loaded onto the tool with the screw tightened only enough to create light friction in the upper region of the club shaft above the desired location; then it is pushed down to the desired location and then secured in place there by rotating the screw clockwise to tighten it securely then the tool is removed.

To relocate the device for "fine tuning" or removal, the tool is reinserted and the screw is rotated counter-clockwise to reduce the holding friction sufficiently to remove the device or shift it up or down as required to a new location where it is again secured as described.

DETAILED DESCRIPTION

Figure 1:
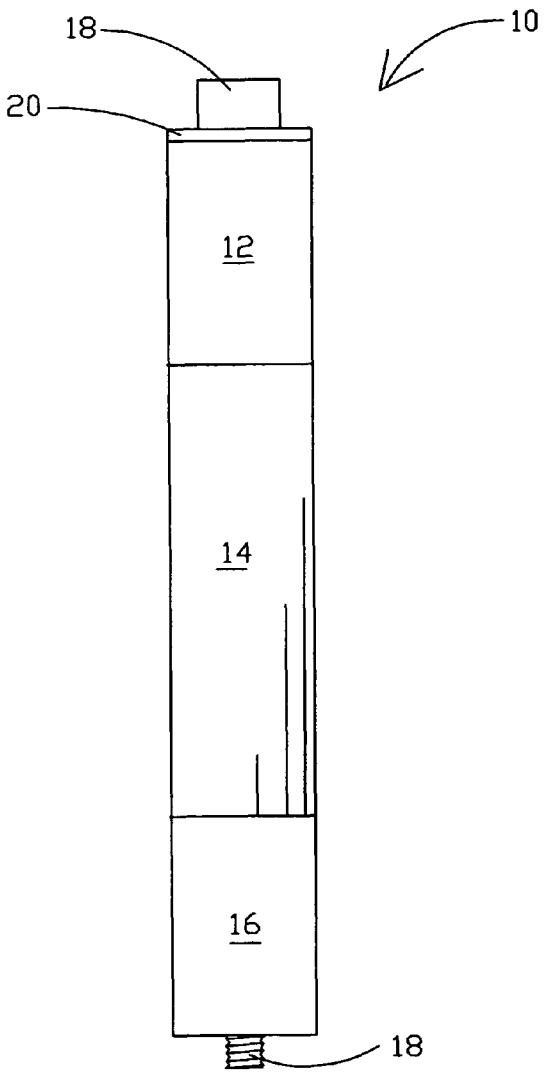
FIG. 1 is an elevational view of a weight device in a primary embodiment of the present invention.

FIG. 1 is an elevational view of a weight device 10 in a primary embodiment of the present invention. A first expansion element 12 of rubber or other elastic material, a weight element 14 and a second expansion element 16 similar to element 12, are held together in a collinear elongated cylindrical assembly, as shown, by a machine screw 18 traversing central openings in the three elements and a washer 20 under the head of machine screw 18.

Figure 2:
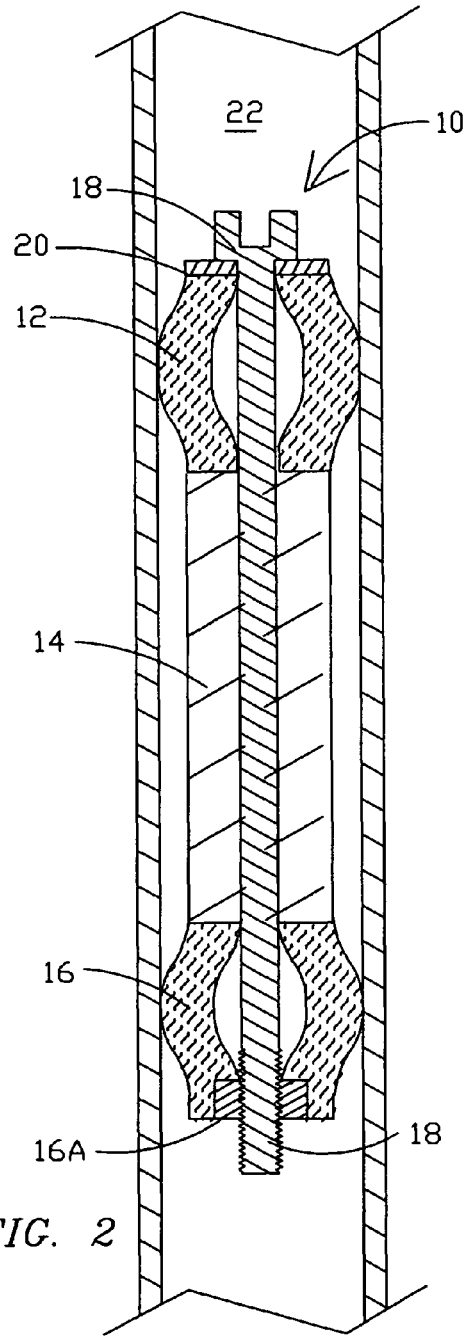
FIG. 2 is a cross-section of the weight device of FIG. 1, shown installed in a golf club shaft, shown in part.

FIG. 2 is a cross-section of the weight device 10 of FIG. 1, shown installed in a golf club shaft 22, shown in part. Screw 18, engaging a threaded bushing 16A at the lower end, has been tightened sufficiently to expand the diameter of both expansion elements 12 and 16 so as to bear firmly against the inside surface of shaft 22, securing weight device 10 in place. The golf club shaft 22 is typically made with a bore that tapers from about 2" in diameter at the top cap end to about ⅜" at the lower end. To accommodate this variation, a standard version of weight device 10, for the major upper portion of the shaft 22, is made with the weight element 14 and the (unexpanded) expansion elements 12 and 16 typically ⅜" in diameter, and a scaled-down version for a minor lower portion of the shaft 22, is made with these elements typically ¼" in diameter.

The weight device 10 is made to have, a designated total weight by the length of the weight element 14 and the density of its material, e.g. brass for high density. It is supported in a firm but resilient manner that prevents any metal-to-metal contact with shaft 22, as deemed optimal for performance characteristics. At the lower end of screw 18 the threads at the extreme lower end of the threaded portion are crimped so as to keep screw 18 captive and avoid unintended disassembly of weight device 10 during removal or repositioning. In the standard version of weight device 10, the weight element 14 and the expansion elements 12 and 16 are 3/16" in diameter.

Figure 3:
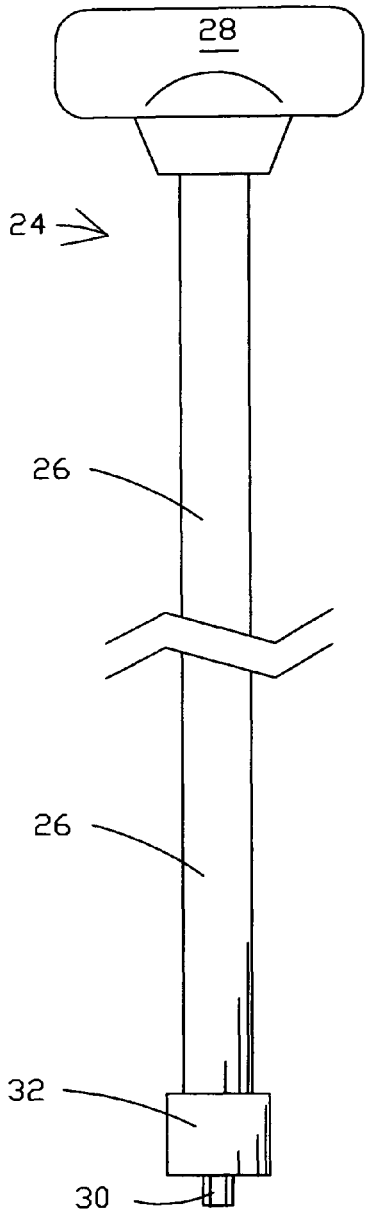
FIG. 3 is an elevational view of a manual driver tool for installing, adjusting and removing the weight device of FIG. 1.

FIG. 3 is an elevational view of a driver tool 24 for installing, adjusting and removing the weight device 10 of FIGS. 1 and 2. A metal rod shaft 26, made approximately the length of a golf club bore, has a blade handle 28 attached at the top end for manual rotation. At the lower end, a hex driver member 30 extends downwardly from a cylindrical permanent magnet 32 attached immediately above.

Figure 4:
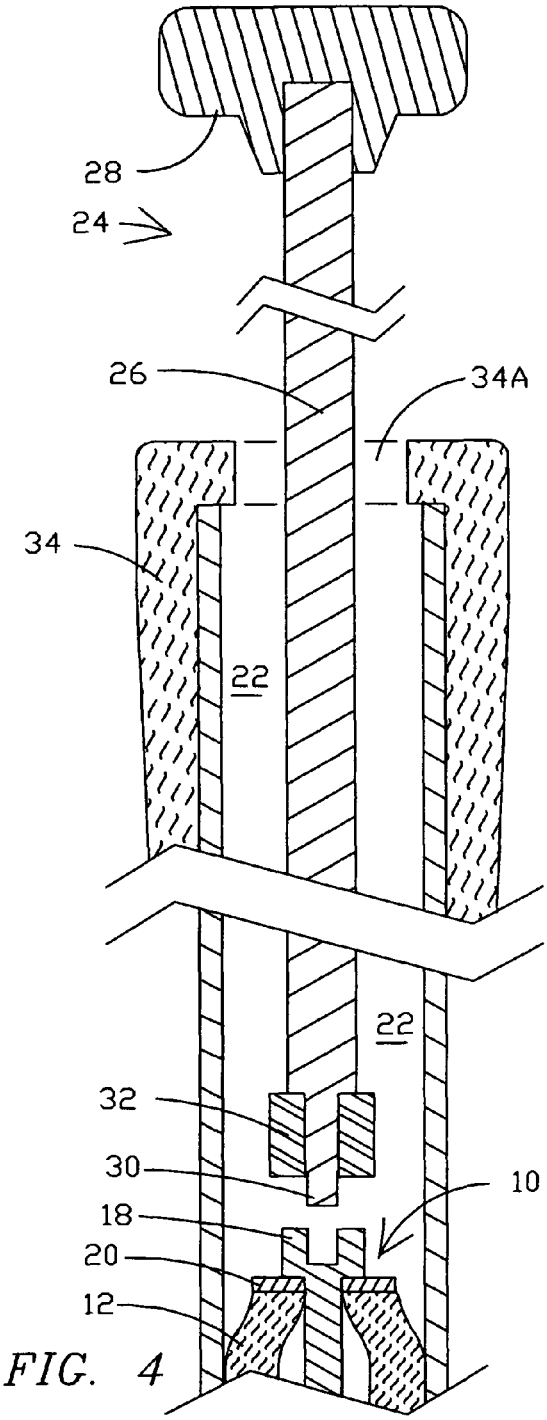
FIG. 4 is a cross section of the tool of FIG. 3 inserted through the cap of a grip showing the driver member on the shaft of FIG. 2 about to engage the weight device of FIG. 1, shown in part.

FIG. 4 is a cross-section of shaft 22 equipped with a golf hand grip 34, and with a weight device 10 (FIG. 2), shown in part, and a tool 24 (FIG. 3) having been inserted through a circular opening 34A that has been cut in cap portion 34A of grip 34. Opening 34A has a diameter equal or near that of the inside of shaft 22 at its top end. At the bottom end of tool 24, an Allen hex driver member 30 is in position immediately above the corresponding hex head of machine screw 18 ready for engagement. Magnet 32 is magnetized in a manner to magnetically attract the (steel) head of machine screw 18 when nearby, and to abruptly force closure of the air gap to fully engage the hex driver member 30 in the head of screw 18. The weight device 10 can then be relocated or withdrawn by first rotating screw 18 counter-clockwise to reduce the axial pressure and partially relax the expansion elements 12 and 16 to release their grip on shaft 22 to an optimally low amount of residual friction to facilitate relocation or withdrawal. For upward relocation or withdrawal, magnet 32 provides the transmission of the necessary amount of tensile pulling force.

Figure 5:
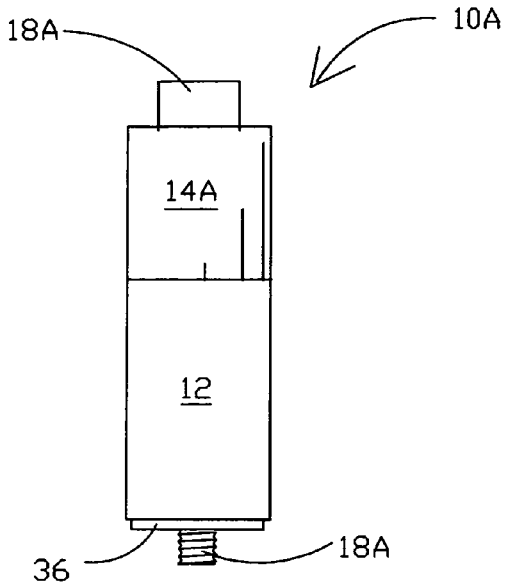
FIG. 5 is an elevational view of a secondary embodiment of a weight device of the present invention.

FIG. 5 is an elevational view of a secondary embodiment of a weight device 10A of the present invention that has fewer parts and that may serve as an added auxiliary mass that can be located near the primary weight device or elsewhere. A relatively short weight element 14A is located directly under the head of bolt 18A, and the single compression element 12 is fitted at the lower end with a threaded "T-nut" 36, as an alternative to bushing 16A (FIG. 2).

Figure 6:
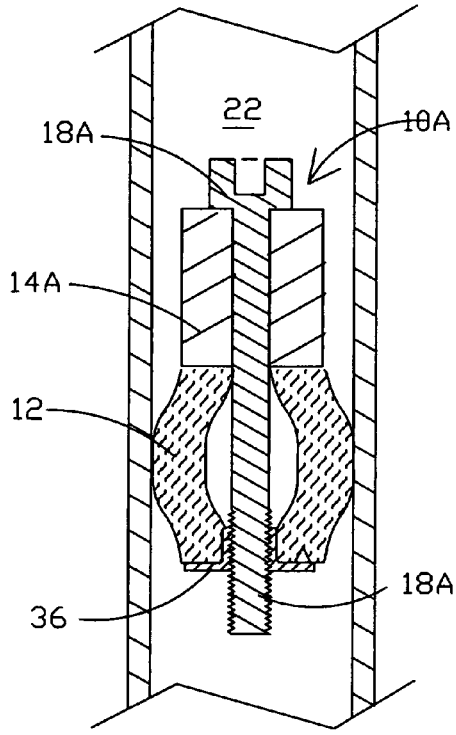
FIG. 6 is a cross-section of the weight device of FIG. 5 installed in golf club shaft, shown in part.

FIG. 6 is a cross-section of the second embodiment weight device of FIG. 5 installed in golf club shaft 22, shown in part. T-nut 36, forming a threaded bottom end plate, is a commercial hardware product that is available with a set of spurs that extend upwardly into the expansion element 12 as indicated, for anti-rotation purposes. Insertion, relocation and removal for this second embodiment weight device are as previously described for the primary embodiment weight device 10. While the dual expansion element mounting of the primary embodiment is inherently extremely robust with a weight element of practically any desired length, with the secondary embodiment having only the single expansion element, the weight element should be kept relatively short in length and possibly tapered to a smaller diameter at the upper end to prevent possibility of contact with the shaft in the event of off-axis displacement if the expansion element is not adequately secured in place. Possibility of such contact can be avoided by shortening of the weight element 14A to the extreme of making it simply a metal washer of designated thickness, or a stack of several washers; the expansion element 12 may be lengthened for weight increase.

Figure 7:
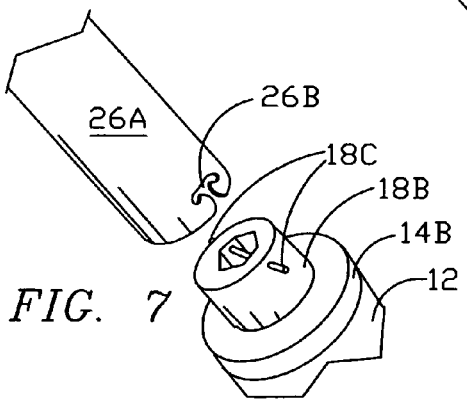
FIG. 7 is a three-dimensional view depicting a first alternative non-magnetic tool and bayonet engagement method for weight device relocation/removal.

FIG. 7 is a three-dimensional view depicting a first alternative tool 26A and a corresponding bayonet engagement method for weight device relocation/removal that eliminates the need for a magnet on the tool. In this example, washer 14B forms a weight element and end plate for expansion member 12, shown in part. Screw head 18B is fitted with one of more extending bayonet pins 18C: in this example a single pin 18C traversing the head 18B extends outwardly as two diametrically opposed pins. Tool 26A may be a hollow tube or may be a solid shaft fitted at the bottom end with a hollow sleeve: near the bottom end tool 26A is configured with one or more specially shaped T slots 26B as shown, one for each bayonet pin 18C on head 18B.

Figure 8:
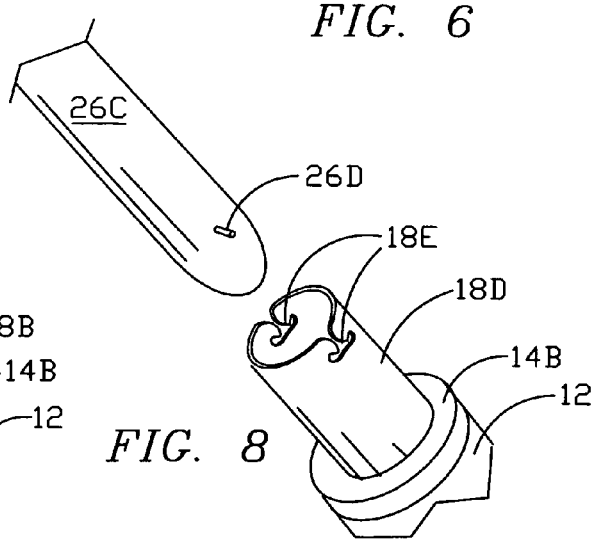
FIG. 8 is a three-dimensional view depicting a second alternative non-magnetic tool and bayonet engagement method for weight device relocation/removal.

FIG. 8 is a three-dimensional view depicting a second alternative non-magnetic tool utilizing a bayonet engagement method for weight device relocation/removal. In this example the tool 26C may be a solid rod with the lower end preferably in the bullet shape shown and fitted with a pair of bayonet pins 26D. A sleeve 18D fastened to the bolt head of the weight device is configured with a pair of T slots as shown.

The configurations of FIGS. 7 and 8 are essentially inversions of each other, and function in a similar manner. When engaged with pins located at one or other end region of the T slots, the tool can rotate the screw head clockwise or counter-clockwise, and can pull the weight device upwardly for relocation or removal. For release of tool from the screw head, a slight rotation of the tool relocates the bayonet pins centrally in the T slots in line with the slot entrance. In either version, alternatively, a single short pin could be utilized, or a set of two, three or more short pins could be arranged in a polar array and secured in place in drilled holes. Alternatively the slots could be L-shaped, in the manner of well known auto lamp sockets.

To provide a range of weight that can be added to a golf club, the weight devices may be made available in selected steps; e.g. three basic weights: 50, 25 and 12.5 grams enable the weight to be set to any desired value from 12½ grams in steps of 12½ grams. The 50 gram weight device can be made in the primary embodiment using a brass weight element ⅜" by about 4" long. Weighting can be performed with one, two or more weight devices; they can be located together or located independently anywhere along the shaft. The 12.5 gram weight device, and even a 6¼ gram "fine tuner", may be made either in the primary embodiment, possibly utilizing a plastic weight element, and/or made in the secondary embodiment.

A single weight device may be located anywhere along the shaft length, and with more than one weight device there is full flexibility of locating the devices close together or elsewhere throughout the shaft length.

As an alternative to utilizing a magnet for pulling the weight element to move it upwardly, a mechanical system could utilize a bayonet pin/slot type engagement, generally similar to that found on bayonet base electric lamps, particularly automotive lamps. The L shaped slots could be oriented opposite their normal direction, so that the fastening would tend to stay engaged for pulling purposes while urging the tool counter-clockwise.

The invention may be embodied and practiced in other specific forms without departing from the spirit and essential characteristics thereof. The present embodiments are therefore to be considered in all respects as illustrative and not restrictive, the scope of the invention encompassing all variations, substitutions, and changes that come within the meaning and range of equivalency of the claims therefore are intended to be embraced therein.

What is claimed is:

1. A golf club weighting system, providing a weight device that can be adjustably secured within a tubular shaft of a golf club within a designated region thereof having a first inside diameter at a lower end and a second inside diameter no smaller than the first diameter at an upper end, comprising:

a cylindrical weight sleeve having a designated outer diameter smaller than the first inside diameter, and having a central axial bore of designated screw clearance diameter;

at least one cylindrical expansion sleeve of resilient material, having, in an unexpanded state, an outer diameter approximating the designated outer diameter of said weight sleeve, having a central axial bore of the designated screw clearance diameter in a major portion of said expansion sleeve and having a central axial bore of at least the designated screw clearance diameter at a minor end portion opening to an annular flat end surface of said expansion sleeve;

a cylindrical threaded bushing, fitted into the minor end portion of the expansion sleeve bore;

a machine screw, traversing the bore of said weight sleeve, configured with an enlarged head portion with an underside thereof bearing against a first end surface of said weight sleeve, said machine screw traversing said expansion sleeve and threadedly engaging said threaded bushing; and said weight sleeve and said expansion sleeve being assembled together with said machine screw in threaded engagement with said threaded bushing but initially tightened only to a lightly-stressed threshold condition, thus forming the weight device and initiating a sliding-friction mode wherein a user is enabled to insert the weight device into the golf club shaft and move the weight device to a desired location within the designated region of the golf club shaft, whereupon tightening of said machine screw will compress said expansion sleeve axially and further expand said compression sleeve radially sufficiently to fasten the weight device in an expansion-secured mode in the desired location in the golf club shaft.

2. The golf club weighting system as defined in claim 1 further comprising:

setup means for insertion of the weight device in the sliding-friction mode into the golf club shaft, for initiating the expansion-secured mode and thus securing the weight device at a desired location within the designated region of the golf club shaft for deployment in golf play, and for subsequently releasing the weight device to the sliding-friction mode for relocation and for removal from the golf club shaft.

3. The golf club weighting system as defined in claim 2 wherein said setup means comprises:

said machine screw being made from ferro-magnetic metal material and being configured with a driving cavity in the head portion thereof;

an elongate tool shaft, dimensioned for insertion into said golf club shaft, configured at one end with a screw-driving bit made to engage the driving cavity configured in the head of said machine screw; and a permanently magnetized collar fastened, on the tool shaft near the screw-driving bit, made and arranged to magnetically attract and hold the bit engaged in the machine screw head, thus enabling a user to manipulate said tool shaft in a manner to rotate said machine screw in either direction and thus perform transition between the expansion-secured mode and the sliding-friction mode of the weight device, to relocate the weight device up and down within said golf club shaft in the sliding-friction mode and to fasten weight device in a desired location in the golf club shaft in the expansion-secured mode for playing golf.

4. The golf club weighting system as defined in claim 2 wherein said setup means comprises:

an elongate tool shaft, dimensioned for insertion into said golf club shaft;

a first complementary element of a mating pair of bayonet type disengagable fastening elements configured at one end of said tool shaft; and a second and opposite complementary element of the mating pair of bayonet type disengagable fastening elements configured on the head of said screw;

whereby, with the weight device disposed within the golf club shaft, a user is enabled to manipulate said tool shaft in a manner to rotate said machine screw in either direction and thus perform transition between the expansion-secured mode and the sliding-friction mode of the weight device, to relocate the weight device up and down within said golf club shaft in the sliding-friction mode and to fasten the weight device in a desired location in the golf club shaft in the expansion-secured mode for playing golf.

5. The golf club weighting system as defined in claim 4 wherein said first complementary element configured at one end of the tool shaft comprises a sleeve configured with a diametrically opposite pair of double-slot patterns extending to an opening at an end of said sleeve; and said second complementary element configured on the head of said screw comprises a pair of pins extending radially from diametrically opposite sides of the head of said machine screw, made and arranged to removably engage the double-slot patterns in said first complementary element.

6. The golf club weighting system as defined in claim 5 wherein each double-slot pattern is shaped as letter L having a stem and afoot, each pattern being oriented such that the stem extends to the opening at the end of the sleeve.

7. The golf club weighting system as defined in claim 5 wherein each double-slot pattern is shaped as letter T having a stem and a header, each pattern being oriented such that the stem extends to the opening at the end of the sleeve.

8. The golf club weighting system as defined in claim 1 wherein said cylindrical threaded bushing is further configured to have an end flange extending to a circular circumference no larger than that of end of said expansion sleeve in the sliding-friction mode, thus forming in effect a T-nut with the end flange forming a bearing surface interfacing the flat end surface of said expansion sleeve.

9. A golf club weighting system, providing a weight device as a coaxial assembly, disposed about a vertically oriented central axis, that can be adjustably secured within a tubular shaft of a golf club within a designated region thereof having a first inside diameter at a lower end and a second inside diameter no smaller than the first diameter at an upper, comprising:

a cylindrical weight sleeve having a designated outer diameter smaller than the first inside diameter, and having an upper flat end surface and a lower flat end surface, and having a central axial bore of designated screw clearance diameter;

at least a first cylindrical expansion sleeve of resilient material, having a flat upper end surface interfacing the lower flat end surface of said cylindrical weight sleeve, having, in an unexpanded state, an outer diameter approximating the designated outer diameter of said weight sleeve, and having a central axial bore of the designated screw clearance diameter in major portion of said expansion sleeve and having a central axial bore of at least the designated screw clearance diameter at a minor lower end portion, opening to an annular flat lower end surface of said first expansion sleeve;

a cylindrical threaded bushing, fitted into the minor lower end portion of the expansion sleeve bore of said first cylindrical expansion sleeve;

a second cylindrical expansion sleeve of resilient material, having a lower flat end surface interfacing the upper flat end surface of said cylindrical weight sleeve, having, in an sliding-friction state, an outer diameter approximating the designated outer diameter of said weight sleeve, having an upper flat surface, and having a central axial bore of the designated screw clearance diameter;

a flat annular washer having a lower flat surface interfacing the upper flat surface of said second cylindrical expansion sleeve;

a machine screw, configured with an enlarged head portion, inserted through and traversing said flat annular washer, the bore of said second expansion sleeve, the bore of said first cylindrical expansion sleeve and threadedly engaging said threaded bushing but initially tightened only to a lightly-stressed threshold condition, thus initiating, in the thusly assembled weight device, a sliding-friction mode wherein a user is enabled to insert the weight device into the golf club shaft and move the weight device to a desired location within the designated region of the golf club shaft, whereupon tightening of said machine screw will compress said expansion sleeve axially and expand said compression sleeve radially sufficiently to fasten the weight device in an expansion-secured mode in the desired location in the golf club shaft.

10. The golf club weighting system as defined in claim 9 further comprising:

setup means for insertion of the weight device in the sliding-friction mode into the golf club shaft, for initiating the expansion-secured mode and thus securing the weight device at a desired location within the designated region of the golf club shaft for deployment in golf play, and for subsequently releasing the weight device to the sliding-friction mode for relocation and for removal from the golf club shaft.

11. The golf club weighting system as defined in claim 10 wherein said setup means comprises:

said machine screw being made from ferro-magnetic metal material and being configured with a driving cavity in the head portion thereof;

an elongate tool shaft, dimensioned for insertion into said golf club shaft, configured at one end with a screw-driving bit made to engage the driving cavity configured in the head of said machine screw; and a permanently magnetized collar fastened on the tool shaft near the screw-driving bit, made and arranged to magnetically attract and hold the bit engaged in the machine screw head, thus enabling a user to manipulate said tool shaft in a manner to rotate said machine screw in either direction and thus perform transition between the expansion-secured mode and the sliding-friction mode of the weight device, to relocate the weight device up and down within said golf club shaft in the sliding-friction mode and to fasten weight device in a desired location in the golf club shaft in the expansion-secured mode for playing golf.

12. The golf club weighting system as defined in claim 10 wherein said setup means comprises:

an elongate tool shaft, dimensioned for insertion into said golf club shaft;

a first complementary element of a mating pair of bayonet type disengagable fastening elements configured at one end of said tool shaft; and a second and opposite complementary element of the mating pair of bayonet type disengagable fastening elements configured on the head of said screw;

whereby, with the weight device disposed within the golf club shaft, a user is enabled to manipulate said tool shaft in a manner to rotate said machine screw in either direction and thus perform transition between the expansion-secured mode and the sliding-friction mode of the weight device, to relocate the weight device up and down within said golf club shaft in the sliding-friction mode and to fasten the weight device in a desired location in the golf club shaft in the expansion-secured mode for playing golf.

13. The golf club weighting system as defined in claim 12 wherein said first complementary element configured at one end of the tool shaft comprises a sleeve configured with a diametrically opposite pair of double-slot patterns extending to an opening at an end of said sleeve; and said second complementary element configured on the head of said screw comprises a pair of pins extending radially from diametrically opposite sides of the head of said machine screw, made and arranged to removably engage: the double-slot patterns in said first complementary element.

14. The golf club weighting system as defined in claim 13 wherein each double-slot pattern is shaped as letter L having a stem and a foot, each pattern being oriented such that the stem extends to the opening at the end of the sleeve.

15. The golf club weighting system as defined in claim 13 wherein each double-slot pattern is shaped as letter T having a stem and a header, each pattern being oriented such that the stem extends to the opening at the end of the sleeve.

16. The golf club weighting system as defined in claim 9 wherein said cylindrical threaded bushing is further configured to have an end flange extending to a circular circumference no larger than that of end of said expansion sleeve in the sliding-friction mode, thus forming, in effect, a T-nut with the end flange forming a bearing surface interfacing the flat end surface of said expansion sleeve.

* * * * *